US006860440B2

(12) United States Patent
Crane et al.

(10) Patent No.: US 6,860,440 B2
(45) Date of Patent: Mar. 1, 2005

(54) HAMMERMILL

(75) Inventors: Ray Crane, Columbus, MS (US); Nordahl K. Johnson, Puyallup, WA (US)

(73) Assignee: Weyerhaeuser Company, Federal Way, WA (US)

( * ) Notice: Subject to any disclaimer, the term of this patent is extended or adjusted under 35 U.S.C. 154(b) by 64 days.

(21) Appl. No.: 10/336,388

(22) Filed: Jan. 2, 2003

(65) Prior Publication Data

US 2004/0129808 A1 Jul. 8, 2004

(51) Int. Cl.[7] ..... B02B 1/00

(52) U.S. Cl. ..... 241/57; 241/185.5; 241/186.2; 241/189.1

(58) Field of Search ..... 241/57, 185.5, 241/186.2, 187, 188.1, 189.1, 195, 292.1

(56) References Cited

U.S. PATENT DOCUMENTS 3,966,126 A * 6/1976 Werner ..... 241/19
4,241,881 A 12/1980 Laumer
4,650,127 A * 3/1987 Radwanski et al. ..... 241/28
5,253,815 A * 10/1993 Bowns et al. ..... 241/186.1
5,560,553 A 10/1996 Crane
5,836,527 A * 11/1998 Irwin et al. ..... 241/49
5,967,436 A * 10/1999 Balvanz ..... 241/291
6,405,950 B1 * 6/2002 Gunderson ..... 241/60

* cited by examiner

*Primary Examiner*—Ed Tolan
(74) *Attorney, Agent, or Firm*—Christensen O'Connor Johnson Kindness PLLC

(57) ABSTRACT

A hammermill for singulating cellulosic fibers from a pulp sheet comprises a cylindrical housing, a feed slot with a breaker bar positioned therein and a rotor mounted for rotation in the housing. Feed rolls are provided to feed a sheet of pulp into the feed slot upstream of the breaker bar. A plurality of hammers are mounted on the rotor. Air is introduced into the hammermill housing tangentially downstream from the second feed slot. An air outlet is positioned tangentially on the housing downstream from the air inlet to allow air and singulated fibers to escape.

17 Claims, 6 Drawing Sheets

HAMMERMILL

The present invention relates to hammermills, more particularly to hammermills for singulating cellulose fibers from a pulp sheet, and most particularly to hammermills for singulating cellulose fiber from a wet pulp sheet.

BACKGROUND OF THE INVENTION

Pulp produced from a variety of pulping processes is usually first formed into a dry sheet on a Fourdrinier press and dryer. The pulp slurry is placed on the Fourdrinier press and the liquid is drained therefrom. The wet pulp sheet passes through a press section and into a dryer to remove the excess water. This produces a dry pulp sheet that is conventionally rolled into large rolls for storage and transportation. When the pulp is ready for use, the pulp fibers must be separated from the sheet and, preferably, singulated into individual fibers. Prior to singulation, the pulp may be treated with a cross-linking chemical in aqueous solution. The solution is applied to the pulp sheet in a variety of conventional ways, but results in a chemically treated, wet pulp sheet having a consistency in the range of from 50% to 80%. Singulating chemically treated cellulose fibers having a 50% to 85% consistency is accomplished in a variety of ways. In the past, the pulp sheets have first been run through hammermills and the resulting product run through disk fluffers, pin mills, or other devices to further separate the pulp into individual or singulated fibers. The prior hammermills employed have resulted in poor singulation of the fibers, thus the need for additional processing. Additional processing requires the expenditure of additional energy, thus increasing expense of singulation. In addition, prior hammermills have been exceedingly noisy.

SUMMARY OF THE INVENTION

The present invention provides an improved hammermill for singulating cellulosic fibers from a chemically treated pulp sheet. This hammermill eliminates the need for a disk fluffer or other devices downstream from the hammermill, thus eliminating significant amounts of energy consumption in the singulation process. This hammermill is also much quieter and reduces energy requirements relative to the product produced. The hammermill of the present invention comprises a cylindrical housing having a longitudinal axis. The housing has a first feed slot running longitudinally therealong. A first breaker bar is positioned in the first slot and has an edge extending radially inwardly from the interior wall of the housing. A rotor is mounted for rotation in the housing about the longitudinal axis. Feed rolls are mounted for rotation exterior of the housing for feeding a sheet of pulp into the first feed slot upstream of the breaker bar. A plurality of hammer segments are mounted on the rotor. The hammers have tips extending radially therefrom. The hammer tips pass in close proximity to the breaker bar so as to separate fibers from the sheet as the hammers rotate on the rotor. In a preferred form, the hammermill comprises a second feed slot located downstream from the first slot, a second breaker bar positioned in said second slot, and a second set of feed rolls mounted for rotation exterior of the housing for feeding a sheet pulp into the second feed slot upstream from the second breaker bar. The hammers pass in close proximity to the second breaker bar so as to separate fibers from the second sheet as the hammers rotate. An air inlet running longitudinally along the housing is positioned downstream from the second feed slot. The air inlet is oriented tangentially to the housing so that air is introduced tangentially along the inside of the housing. An air outlet also runs longitudinally along the housing. The air outlet is oriented tangentially to the housing to allow air and singulated fibers to escape in a tangential direction from the housing.

In the preferred embodiment, each hammer has a plurality of hammer tips, preferably in the ranged of from 12 to 24. The hammer tips are equidistantly spaced about the periphery of the rotor. The hammer tips on a given hammer are slightly offset from adjacent hammer tips so as to form a W pattern. The W pattern preferably has a pair of peaks leading in the direction of rotation that are positioned approximately one-quarter of the length of the rotor inwardly from opposite edges of the rotor. The W pattern positions a valley in the center of the rotor between the peaks. Because each of the rotors has an equal number of hammer tips, this positions the hammer tips in fifteen sets of saw-toothed patterns around the circumference of the rotor. Each of these segments is stacked on the shaft of the rotor in a manner to develop a hammer tip W configuration throughout the circumference and full length of the rotor.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
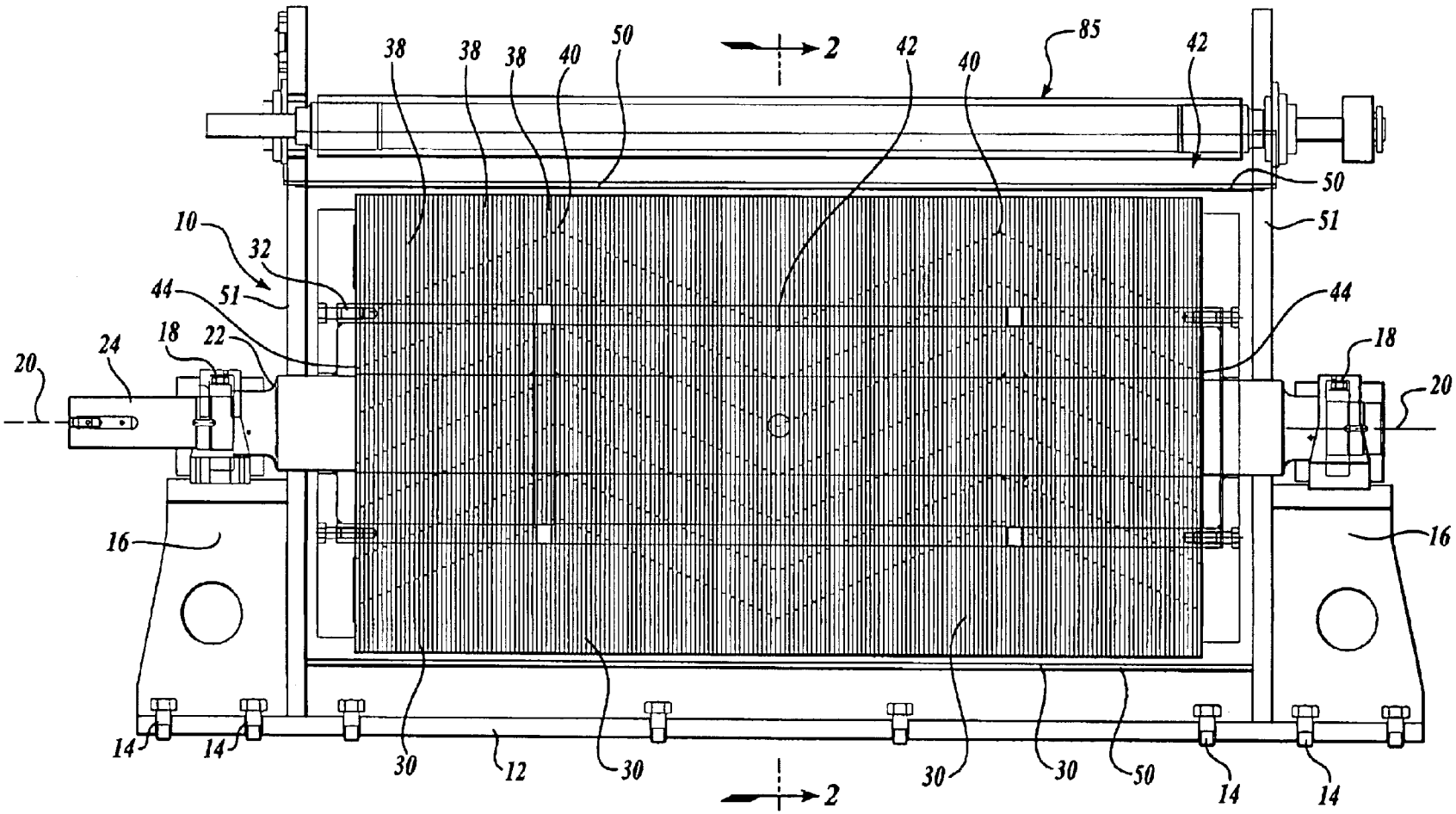
FIG. 1 is an elevation view of the hammermill of the present invention showing the rotor carrying a plurality of hammers and showing the rotor housing broken away, and taken along a view line similar to 1—1 of FIG. 2 with the breaker bar assembly omitted.
Figure 2:
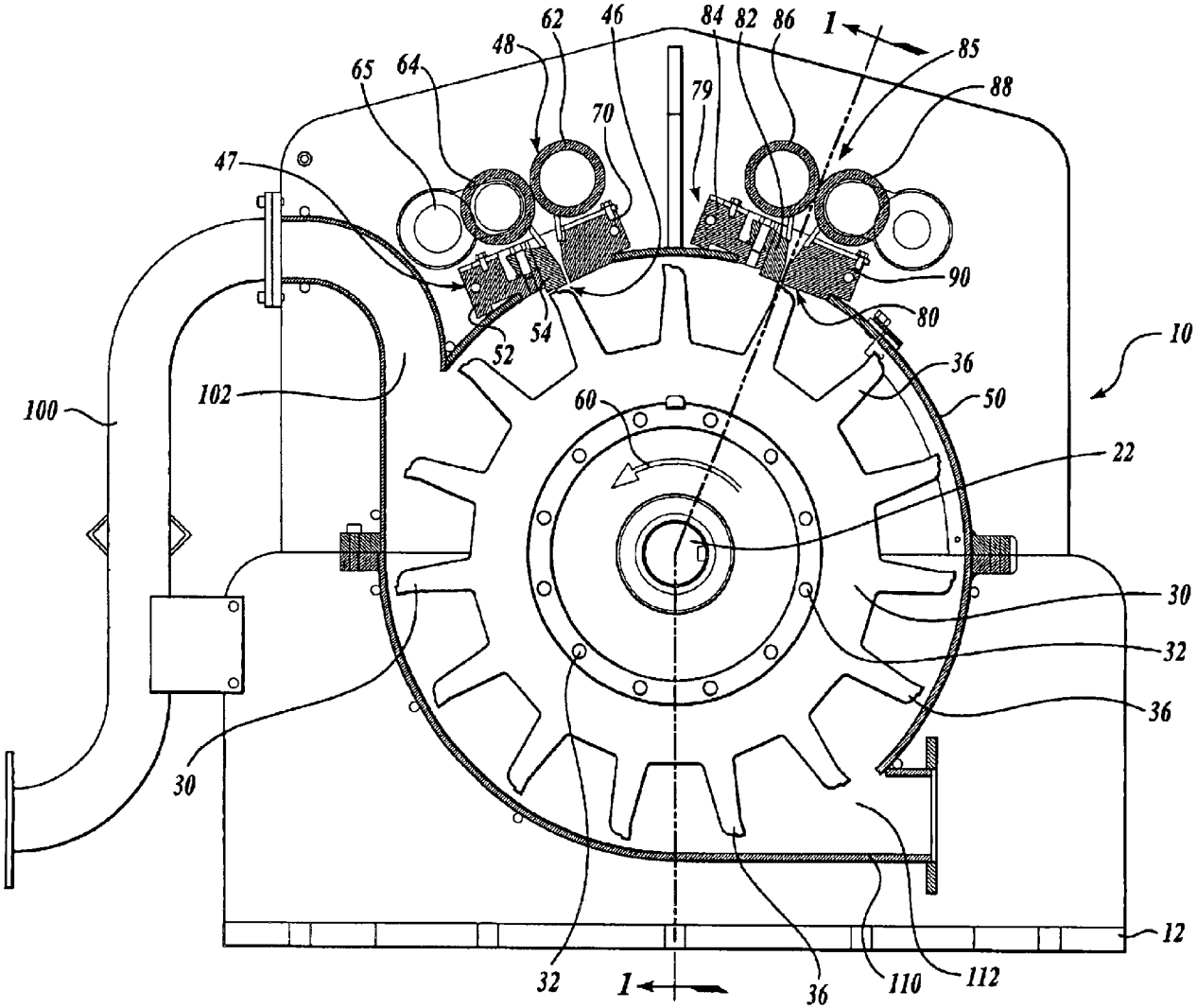
FIG. 2 is a cross-sectional view of the hammermill taken along the section line 2—2 of FIG. 1.

Referring to FIGS. 1 and 2, the hammermill generally designated 10 rests on a base 12. The base 12 may be fastened to a foundation floor or other object for securement by a plurality of fasteners 14. A pair of bearing stands 16 are spaced longitudinally apart on the base 12. A pair of bearings 18 are supported on the bearing stands 16 and are aligned along a longitudinal rotational axis generally designated 20. A rotor shaft 22 is mounted for rotation in the bearings 18. The rotor shaft 22 has an extension 24 on its one end onto which a drive coupling may be mounted.

A plurality of hammer segments 30 (represented by disks in FIG. 1) are mounted on the shaft 22. The hammer segments are affixed to the shaft and to each other by conventional means such as a plurality of bolts 32 extending through holes arranged circumferentially around the shaft 22. In this case, there are twelve bolts 32 arranged in a circular pattern. If desired, the hammers can be separated from adjacent hammers by spacers or can be positioned directly adjacent to each other. Other means of attaching the hammers to the shaft, such as keys or an octagonally shaped rotor shaft, may be employed.

In this embodiment, each hammer 30 has a plurality of hammer tips or blades 36 that extend radially outwardly from the hammermill shaft base. (Only one hammer segment is shown in FIG. 2 for purposes of clarity.) In accordance with the present invention, each of the hammer segments has from 12 to 24 blades, preferably fifteen blades, that are equally spaced about the periphery of each of the segments 30. Each of these blades is circumferentially offset from the blades of the next adjacent hammer segment. The blades are offset so that the blades form a W or herringbone pattern when viewed from the side. This herringbone pattern is schematically illustrated by the offset dashes 38 in FIG. 1. In the preferred embodiment, the herringbone pattern is arranged such that two peaks 40 are provided as leading edges of the pattern in the direction of rotation of the rotor (arrow 60, FIG. 2). Offset in a direction opposite the direction of rotation are a central valley 42 and two edge valleys 44 adjacent the ends of the rotor. The peaks 40 are positioned inwardly from the ends of the rotor approximately one-fourth of the distance of the overall length, while the central valley is positioned at the middle of the rotor. A variety of other patterns may be employed as desired.

Figure 3:
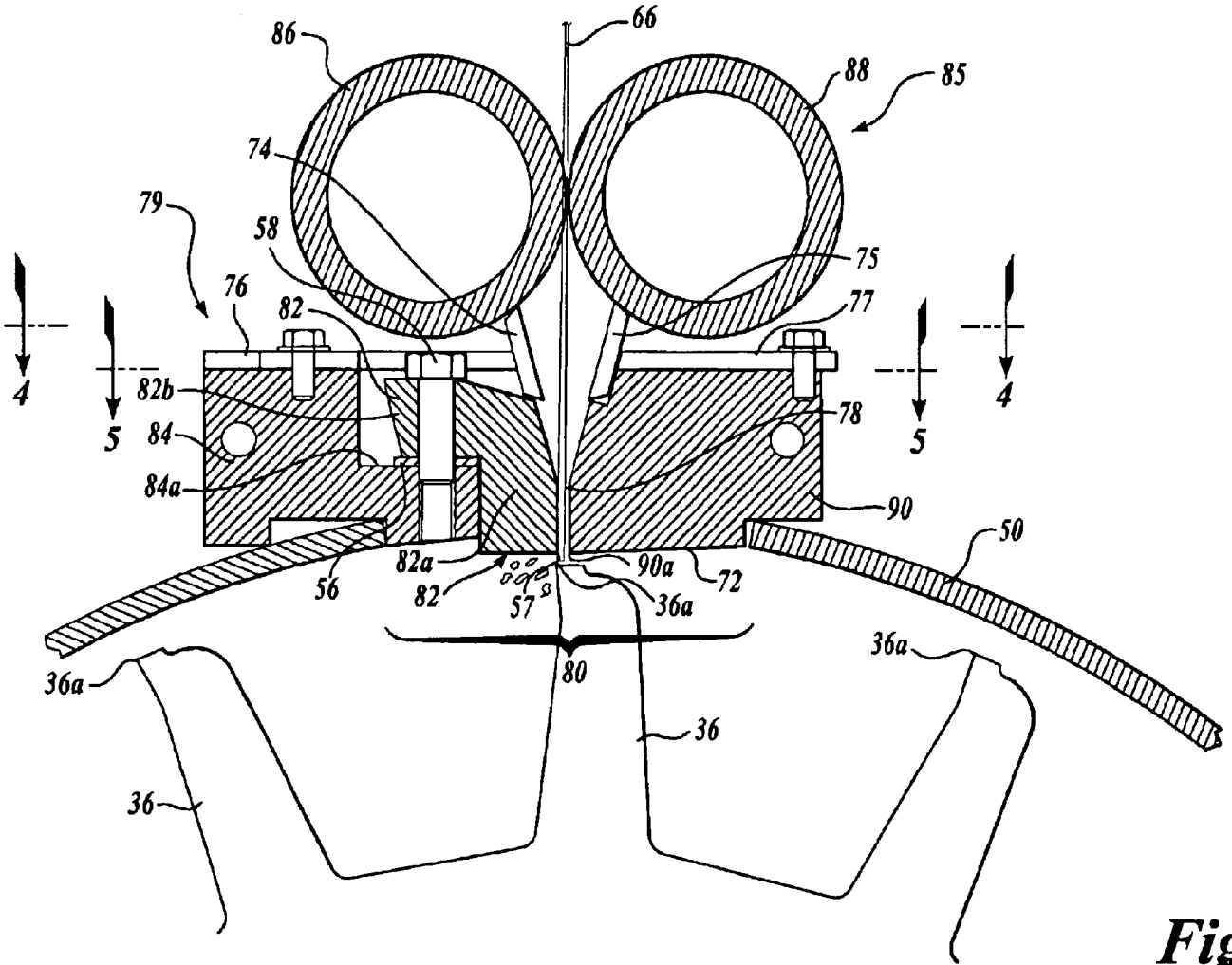
FIG. 3 is an enlarged sectional view of the breaker bar, mounting bars and feed rollers feeding a sheet of pulp into the hammermill of FIG. 2.
Figure 4:
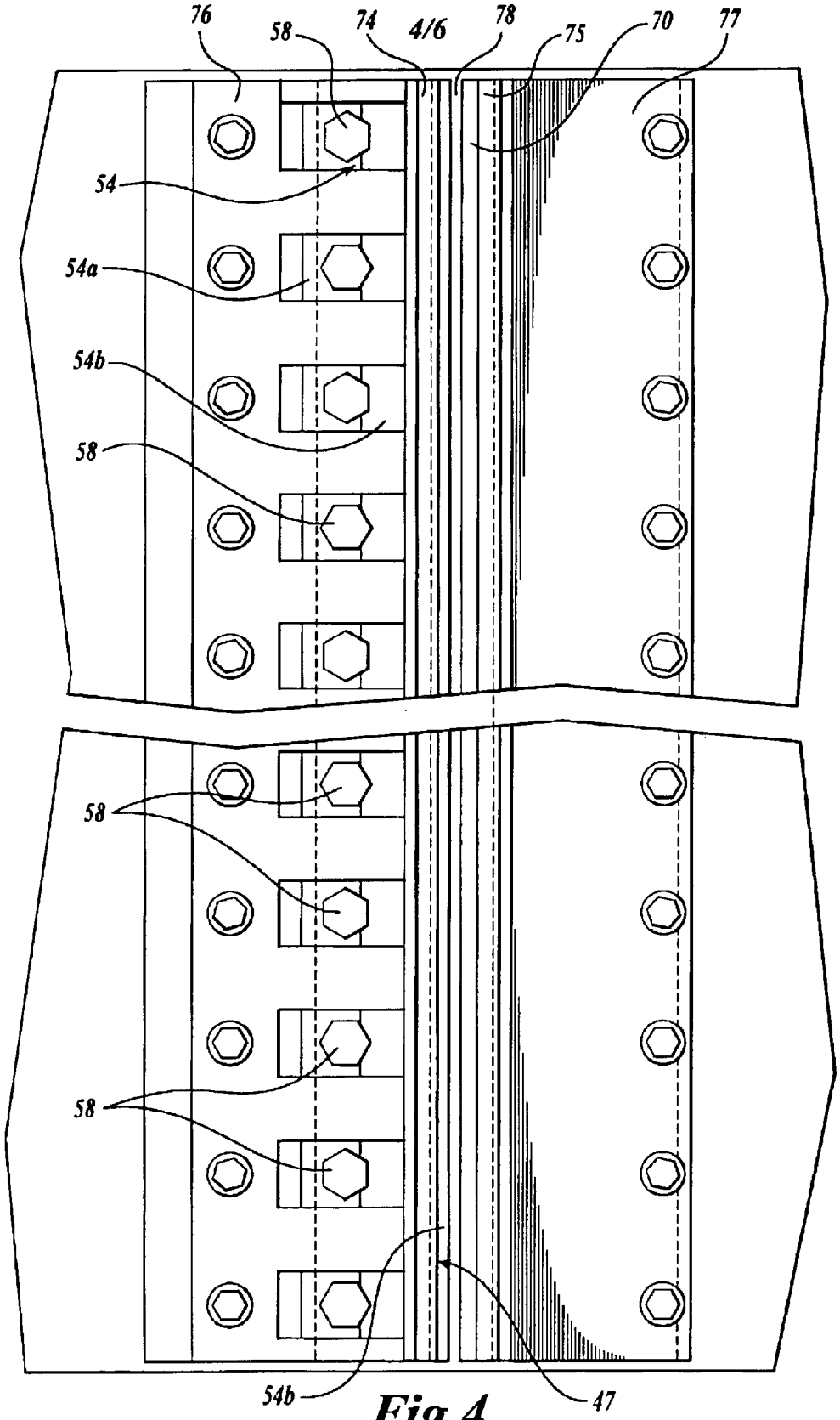
FIG. 4 is a sectional view taken along section line 4—4 of FIG. 3 showing the exterior of sheet guides, breaker bar, and the mounting means therefor.
Figure 5:
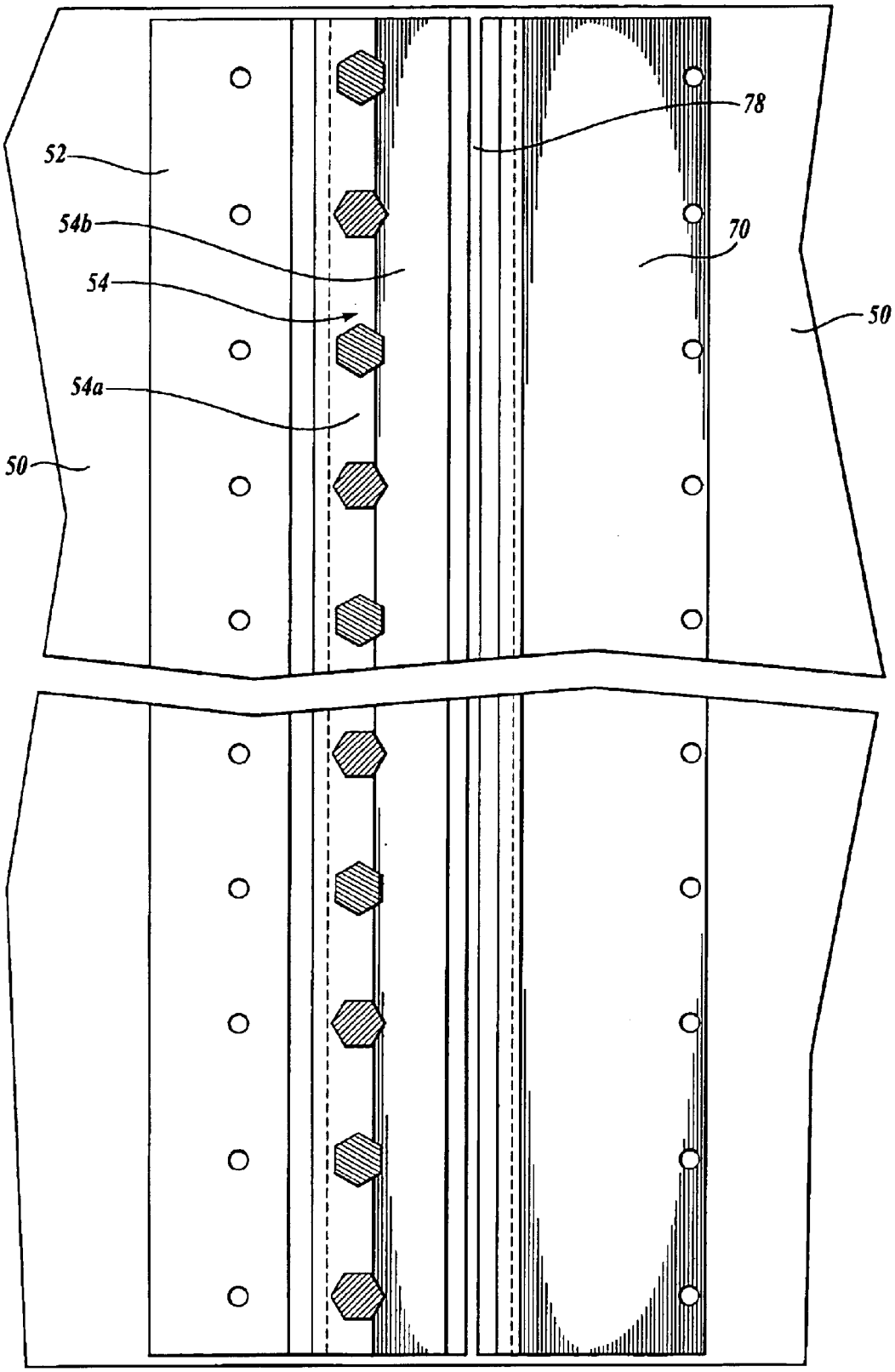
FIG. 5 is a sectional view similar to that of FIG. 4 taken along section line 5—5 of FIG. 3.

Referring to FIGS. 1 through 3, the rotor and hammer segments 30 are housed in a generally cylindrical housing 50 bounded on the ends by sidewalls 51. The housing has a diameter that is slightly larger than the outside diameter of the hammer segments 30. The housing carries a first slot 80 positioned in a first quadrant (upper right-hand quadrant) of the housing. The slot 80 extends longitudinally across the housing and is coextensive with the length of the rotor. A breaker bar assembly 79 is mounted over and is also coextensive with the slot 80. A feed roll assembly 85 is mounted in a conventional manner outwardly from the slot 80 and breaker bar assembly 79.

A breaker bar mount 84 is positioned exterior of the housing 50 and has a portion that extends into the downstream side of the slot 80. An L-shaped breaker bar 82 is adjustably mounted on the breaker bar mount 84. The breaker bar 82 has one arm 82*a* that extends radially inwardly into the slot and another arm 82*b* that extends over a shoulder 84*a* of the breaker bar mount 84. The breaker bar arm 82*b* is spaced from the shoulder 84*a* by spacers 56. The leading edge 57 of the arm 82*a* of the breaker bar is positioned at a location slightly inwardly from the inner wall of the housing 50 and is also spaced slightly outwardly from the leading edge tips 36*a* of the hammer blades 36. As the rotor rotates in the counterclockwise direction as indicated by arrow 60 in FIG. 2, the hammer tips 36*a* pass in close proximity to the leading edge 57 of the breaker bar arm 82*b*.

A pair of feed rolls 86 and 88, forming part of the feed roll assembly 85 are mounted in a conventional manner outwardly from the slot 80. The feed rolls 86 and 88 are driven in a conventional manner via a drive gear and motor. The feed rolls 86 and 88 are oriented longitudinally over the slot so that the nip of the feed rolls is positioned directly above the slot opening 78 and leading edge 57 of the breaker bar arm 82*b*. A pulp sheet 66 is fed between the feed rolls 86 and 88 into the slot 80 immediately upstream from the leading edge 57 of the breaker bar 82. A guide member 90, forming part of the breaker bar assembly, extends longitudinally along the slot 80 upstream from the breaker bar 82. The guide member 90 is attached to the exterior of the housing 50 in a conventional manner and has a lower sloped surface 72 that is sloped radially inwardly from the inner wall of the housing and in a downstream direction. (This guide member is described in detail in prior U.S. Pat. No. 5,560,553, assigned to Weyerhaeuser Company.). The forward edge 90*a* of the guide member 90 terminates a short distance upstream from and radially outwardly from the leading edge 57 of the breaker bar 82. The pulp sheet 66 is fed between breaker bar 82 and the forward edge 90*a* of the guide member 90. The guide member 90 and its sloped inner surface 72 are provided to prevent fibers from bunching up ahead of the leading edge 57 of the breaker bar 82 by deflecting the opened fibers downwardly.

A pair of guide bars 74 and 75 are mounted on the breaker bar assembly 79. The bars are positioned on each side of the pulp sheet 66 and extend inwardly and toward each other from below respective feed rolls 86 and 88 to a location adjacent the breaker bar 82 and guide member 90. The guide bars are mounted on mounting flanges 76 and 77, in turn fastened by conventional fasteners to the top of the breaker bar mount 84 and guide member 90. The guide bars 74 and 75 serve to ensure that the pulp sheet 66 is fed to the gap 78 between the breaker bar 82 and the guide member 70.

Returning to FIG. 2, in the preferred embodiment, a second slot 46 is provided along with a second breaker bar assembly 47, which includes second breaker bar 54, second breaker bar mounting bar 52 and second guide member 70. A second set 48 of feed rolls 62 and 64 are provided to supply a second sheet of pulp (not shown in FIG. 2) through the slot 46 and into the hammermill. The second feed roll assembly 48 of feed rolls and the breaker bar assembly 47 are positioned in a quadrant downstream from the first quadrant (upper left hand quadrant) where the first breaker bar assembly 79 is situated. Preferably, the first and second slots 80 and 46 are positioned so that the angle the pulp sheets make relative to a radius of the rotor as they are fed through the slots to the breaker bar assemblies is less than 45 degrees, is preferably less than 25 degrees, and is most preferably about 22 degrees.

Still referring to FIG. 2, air is fed into the hammermill through an inlet conduit 100. The inlet conduit feeds into an air inlet 102, which has an opening extending longitudinally along the entire length of the housing 50. The air inlet 102 spans the entire distance of the rotor tips. The air inlet 102 is oriented so as to introduce air into the interior of the housing 50 tangentially along the inner surface of the housing 50. This aids in circulation of the singulated fibers through the hammermill to an outlet 110 located in the fourth quadrant of the hammermill. The air outlet conduit 110 has an opening 112 that extends longitudinally across the entire length of the housing 50, coextensive with the lateral extent of the air inlet opening 102. Air and singulated fibers are thus extracted from the hammermill through the opening 112 into the outlet conduit 110 and by a product conveying fan (not shown). The outlet conduit 110 is positioned downstream from and at an angle from the inlet so that the airstream and fibers on hammers travel part of the way around the housing. This fiber-air stream interaction facilitates separation of the fibers from the hammers and their exit from the outlet conduit 110. It is preferred that the air inlet 102 be positioned at a location less than 90 degrees downstream from the second feed slot 46. It is also preferred that the outlet conduit 110 be positioned at a location on the order of 90 degrees and preferably from 90 degrees to 180 degrees downstream from the air inlet.

Figure 6:
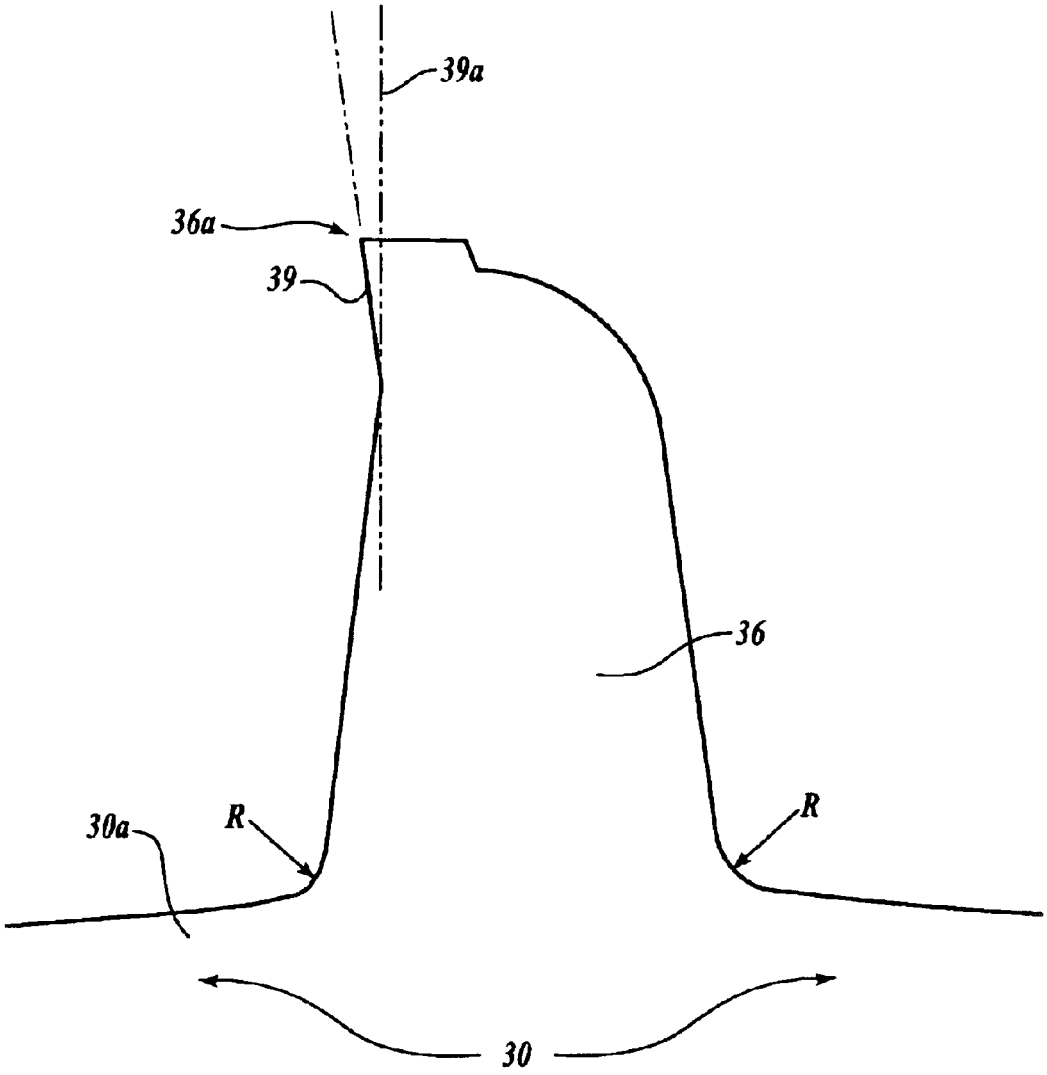
FIG. 6 is an enlarged elevation view of one hammer tip showing the angle the leading edge thereof makes with the radius of the rotor.

Referring to FIG. 6, a single hammer blade 36 is shown so that it's leading edge 39 can clearly be seen. The leading edge 39 extends inwardly from the hammer tip 36*a*. The leading edge preferably defines an angle with a radius 39*a* of the rotor of from −4 to 10 degrees, and preferably from 4 to 6 degrees, where the positive angle extends in the direction of rotation of the rotor. Also, the inner end of each hammer blade 36 is radiused into the base 30*a* of each hammer segment. The preferred radius (R) is about 2.5 mm. This radius helps prevent fiber buildup at the base of each hammer segment.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hammermill for singulating cellulosic fibers from a pulp sheet comprising:

(a) a cylindrical housing having a longitudinal axis, said housing having at least one feed slot running longitudinally therealong, a breaker bar positioned in said one feed slot and extending radially inwardly from the interior wall of said housing;

(b) a rotor mounted for rotation in said housing about said longitudinal axis;

(c) feed rolls mounted for rotation exterior of said housing for feeding a sheet of pulp into said one feed slot upstream of said breaker bar;

(d) a plurality of hammers mounted on said rotor, said hammers having tips extending radially therefrom, said hammer tips passing a cross said feed slot and in close proximity to said breaker bar so as to separate fibers from said sheet as said hammers rotate;

(e) an air inlet running longitudinally along the length of said housing downstream from said one feed slot, said air inlet oriented tangentially to said housing for introducing air tangentially along the inside of said housing to mix with separated fibers, said air inlet positioned adjacent said one feed slot; and (f) an air outlet running longitudinally along the length of said housing, said air outlet oriented tangentially to said housing to allow air and singulated fibers to escape tangentially from said housing, said air outlet being positioned downstream from and at an angle from said air inlet.

2. The hammermill of claim 1, wherein said air inlet is positioned greater than 90 degrees from said one feed slot.

3. The hammermill of claim 1, wherein said air outlet is positioned greater than about 90 degrees from said air inlet.

4. The hammermill of claim 3, wherein said air outlet is positioned less than 180 degrees from said air inlet.

5. The hammermill of claim 1, further comprising a second feed slot positioned downstream from said first feed slot and upstream from said inlet, and a second breaker bar positioned in said second feed slot and extending radially inwardly from the interior of said housing; and second feed rolls mounted for rotation exterior of said housing for feeding a second sheet of pulp into said second slot, said hammer tips passing in close proximity to said second breaker bar so as to separate fibers from said second sheet as said hammers rotate.

6. The hammermill of claim 5, wherein said breaker bars are adjustably mounted for movement in a generally radial direction.

7. The hammermill of claim 5, wherein said second feed slot is positioned at an angle about 45 degrees downstream from said one feed slot.

8. The hammermill of claim 7, wherein said air inlet is positioned less than 90 degrees downstream from said second feed slot.

9. The hammermill of claim 1, wherein said hammers are arranged on said rotors so that said hammer tips are slightly offset in the direction of rotation from adjacent, longitudinally spaced hammer tips.

10. The hammermill of claim 1, wherein said hammer tips are arranged in a W pattern when viewed from the side.

11. The hammermill of claim 10, wherein said W pattern has two peaks each spaced about one quarter of the distance inwardly from opposite ends of said rotor.

12. The hammermill of claim 1, wherein said hammer segments each have from 12 to 24 tips spaced substantially equally around the circumference thereof.

13. The hammermill of claim 12, wherein said hammer segments each have 15 tips spaced substantially equally around the circumference thereof.

14. The hammermill of claim 1, wherein each of said hammer tips have a leading edge extending inwardly therefrom, said leading edge defining an angle of from −4 to 10 degrees with a radius of said rotor.

15. The hammermill of claim 14, wherein said leading edge defines an angle of from 4 to 6 degrees with a radius of said rotor.

16. The hammermill of claim 1, wherein the inner end of a hammer blade is radiused into the base of a hammer segment.

17. A hammermill for singulating cellulosic fibers from a pulp sheet comprising:

(a) a cylindrical housing having a longitudinal axis, said housing having a first feed slot running longitudinally therealong, a first breaker bar positioned in said first feed slot and extending radially inwardly from the interior wall of said housing;

(b) a rotor mounted for rotation in said housing about said longitudinal axis;

(c) first feed rolls mounted for rotation exterior of said housing for feeding a sheet of pulp into said first feed slot upstream of said breaker bar;

(d) a plurality of hammers mounted on said rotor, said hammers having tips extending radially therefrom, said hammer tips passing in close proximity to said breaker bar so as to separate fibers from said sheet as said hammers rotate;

(e) an air inlet running longitudinally along said housing downstream from said one feed slot, said air inlet oriented tangentially to said housing for introducing air tangentially along the inside of said housing, said air inlet positioned adjacent said one feed slot;

(f) an air outlet running longitudinally along said housing, said air outlet oriented tangentially to said housing to allow air and singulated fibers to escape tangentially from said housing, said air outlet being positioned downstream from and at an angle from said air inlet, said air outlet being positioned greater than about 90 degrees from said air inlet;

(g) a second feed slot positioned downstream from said first feed slot and upstream from said air inlet, and a second breaker bar positioned in said second feed slot and extending radially inwardly from the interior of said housing, said first and second breaker bars being adjustably mounted for movement in a generally radial direction; and (h) second feed rolls mounted for rotation exterior of said housing for feeding a second sheet of pulp into said second slot, said hammer tips passing in close proximity to said second breaker bar so as to separate fibers from said second sheet as said hammers rotate.

* * * * *